US007045722B2

(12) United States Patent
Tsai

(10) Patent No.: US 7,045,722 B2
(45) Date of Patent: May 16, 2006

(54) KEY STRUCTURE OF COMPUTER KEYBOARD

(75) Inventor: Ching Cheng Tsai, Taipei (TW)

(73) Assignee: Chicony Electronics Co., Ltd., (TW)

( * ) Notice: Subject to any disclaimer, the term of this patent is extended or adjusted under 35 U.S.C. 154(b) by 0 days.

(21) Appl. No.: 10/924,860

(22) Filed: Aug. 25, 2004

(65) Prior Publication Data

US 2005/0098414 A1 May 12, 2005

(30) Foreign Application Priority Data

Nov. 6, 2003 (TW) ..... 92219709 U

(51) Int. Cl.
*H01H 9/26* (2006.01)

(52) U.S. Cl. ..... 200/5 R; 200/5 A

(58) Field of Classification Search ..... 200/5 R, 200/5 A, 341–344, 512–517; 400/491.1–496, 400/490; 361/680, 687, 688
See application file for complete search history.

(56) References Cited

U.S. PATENT DOCUMENTS 4,170,104 A * 10/1979 Yamagata ..... 368/289
4,501,936 A * 2/1985 Morse ..... 379/451
6,259,434 B1 * 7/2001 Tsai ..... 345/168
6,491,456 B1 * 12/2002 Shih et al. ..... 400/473
6,664,901 B1 * 12/2003 Yamada et al. ..... 341/22
2002/0175063 A1 * 11/2002 Ito et al. ..... 200/344
2004/0195081 A1 * 10/2004 Narusawa et al. ..... 200/5 A
2005/0000789 A1 * 1/2005 Yoneyama ..... 200/512

* cited by examiner

*Primary Examiner*—Michael Friedhofer
*Assistant Examiner*—Lisa Klaus
(74) *Attorney, Agent, or Firm*—Bacon & Thomas PLLC

(57) ABSTRACT

A key structure is provided. The present key structure includes a key cap, a scissor-type frame, an elastic contact body, a membrane circuit board, and a bottom board. A plurality of flanges is provided on the bottom of the elastic contact body, with the surface of the flange being formed as an embossed surface having a cross-striped structure. A print layer is provided on the area of the membrane circuit board corresponding to the flanges of the bottom of the elastic contact body, such that there is a height difference between the print layer and the membrane circuit board. The print layer is formed of a plurality of discontinuous printing portions between which a plurality of holes is formed. After the elastic contact body is bonded to the membrane circuit board by an adhesive, the press force of the elastic contact body caused by pressing the key can be released via the holes. The bonding area of the bottom of the elastic contact body is increased by the cross-striped structure of the embossed surface so as to enhance bonding between the elastic contact body and the membrane circuit board and prevent the adhesive from being extruded out from therebetween.

13 Claims, 4 Drawing Sheets

KEY STRUCTURE OF COMPUTER KEYBOARD

BACKGROUND OF THE INVENTION

1. Field of the Invention

The present invention relates to a key structure, and more particularly, to a key structure with an elastic contact body having a bottom surface formed as an embossed surface provided with a cross-striped structure. The bonding area of the bottom surface of the elastic contact body is increased by the cross-striped structure so as to enhance bonding between the elastic contact body and a membrane circuit board and prevent the adhesive from being extruded out from therebetween, when assembling components of the key structure.

2. Description of the Related Art

Conventionally, the elastic contact body of the key structure is placed between a key cap and a circuit board. By pressing the key cap, the elastic contact body is caused to press the conductive membrane on the circuit board such that the messages or commands ordered by pressing the keys are transmitted to a display. A conventional keyboard is provided with a plurality of keys between which having a certain interval, and the elastic contact body is provided for matching one of the keys. In order to make the assembling of the key structure more convenient, an integrally formed elastic assembly formed of a plurality of the elastic contact bodies connected with each other is provided, and each of the elastic contact bodies respectively corresponds to one of the keys. The integrally formed elastic assembly is placed between the keys and the circuit board to complete the assembling of the keyboard. However, the manufacture of the integrally formed elastic assembly is highly cost. In order to resolve the above drawback, another kind of elastic contact body bonded to the conductive membrane with the adhesive is provided.

It is cost-reduced for directly bonding the elastic contact body to the conductive membrane. However, as shown in FIG. 5, the bottom surface 11 of this conventional elastic contact body 10 is plane and smooth such that the adherence of the adhesive 20 onto the bottom surface 11 is insufficient, and hence the adhesive 20 is easily extruded out by the bottom surface 11 from between the elastic contact body 10 and the conductive membrane 30 when bonding the elastic contact body 10 onto the conductive membrane 30. As a consequence, the elastic contact body 10 cannot be strongly bonded to the conductive membrane 30 and easily slips therefrom.

SUMMARY OF THE INVENTION

An object of the present invention is to provide a key structure with an elastic contact body having the bottom surface formed as an embossed surface provided with a cross-striped structure. The bonding area of the bottom surface of the elastic contact body is increased by the cross-striped structure so as to enhance bonding between the elastic contact body and a membrane circuit board and prevent the adhesive from being extruded out from therebetween when assembling components of the key structure.

Another object of the present invention is to provide a key structure with a membrane circuit board having a print layer formed of a plurality of discontinuous printing portions provided thereon. For the height difference between the print layer and the membrane circuit board as well as a plurality of holes formed between the discontinuous printing portions, it is not necessary to provide another holes on the elastic contact body when bonding the elastic contact body onto the membrane circuit board with the adhesive.

The key structure for achieving the foregoing objects comprises: a key cap, a scissor-type frame, an elastic contact body, a membrane circuit board and a bottom board. The elastic contact body is bonded to the membrane circuit board by the adhesive. The key structure is characterized in that a print layer formed of a plurality of discontinuous printing portions is formed on the areas of the membrane circuit board corresponding to the flanges of the bottom surface of the elastic contact body, and a plurality of holes are thus formed between the discontinuous printing portions.

The bottom surface of the elastic contact body is formed as an embossed surface.

The membrane circuit board is made of a single or triple-layered circuit board.

The embossed surface formed on the bottom of the elastic contact body has a cross-striped structure or a grained structure.

The bottom surface of the elastic contact body can be further provided with a plurality of holes.

The adhesive can be coated on the bottom surface of the elastic contact body or the print layer of the membrane circuit board.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

Figure 1:
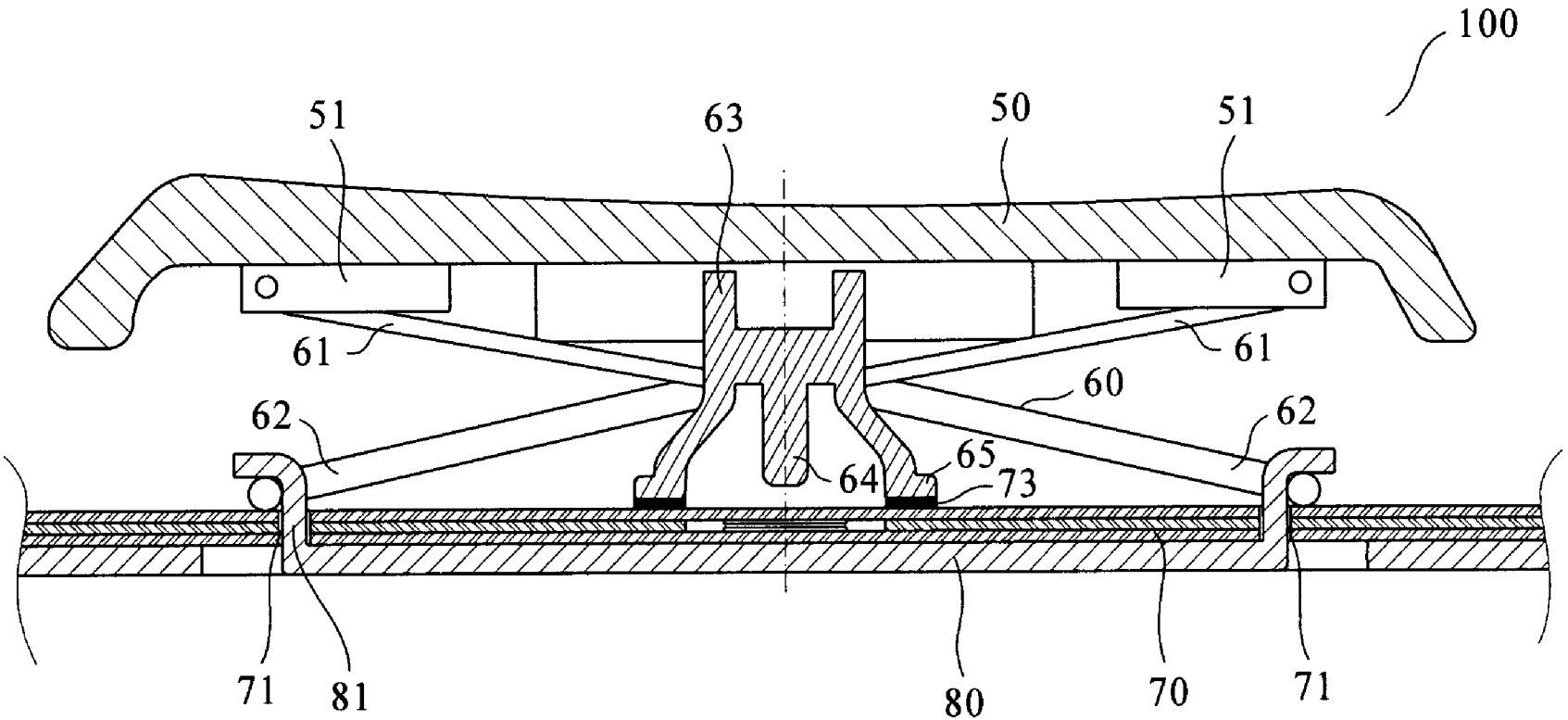
FIG. 1 shows a side sectional view of the key structure according to first embodiment of the present invention.

Please refer to FIG. 1, which shows a side sectional view of the key structure 100 according to first embodiment of the present invention. The key structure 100 of the present invention comprises: a key cap 50, with an upper fixing portion 51 disposed on each of the two sides of the lower portion thereof; a scissor-type frame 60, disposed with a pair of upper pivot joint portions 61 and a pair of lower pivot joint portions 62; an elastic contact body 63, provided with a contact portion 64 and a plurality of flanges 65 on the bottom surface thereof; a membrane circuit board 70, made of a triple-layered circuit board composed of an upper layer, a middle layer and a lower layer, with a pair of through holes 71 passing through the membrane circuit board 70; and a bottom board 80, provided with a pair of lower fixing portions 81 corresponding to the upper fixing portions 51.

Figure 2A:
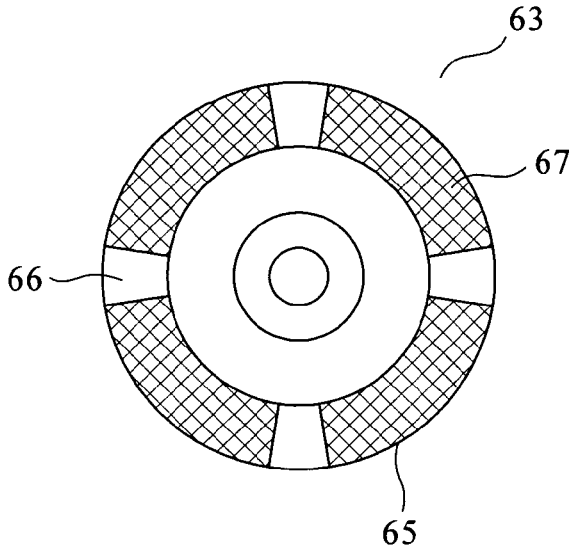
FIG. 2A shows a bottom view of the elastic contact body of the key structure according to first embodiment of the present invention.

Please refer to FIG. 2A, which shows a bottom view of the elastic contact body 63 of the key structure 100 of the present invention, wherein the flanges 65 of the bottom surface of the elastic contact body 63 are formed of a plurality of discontinuous sections by which a plurality of holes 66 is formed. An embossed surface 67 is formed on the bottom of the flanges 65. The embossed surface 67 has a cross-striped structure or a grained structure so as to increase bonding area of the elastic contact body 63.

Figure 2B:
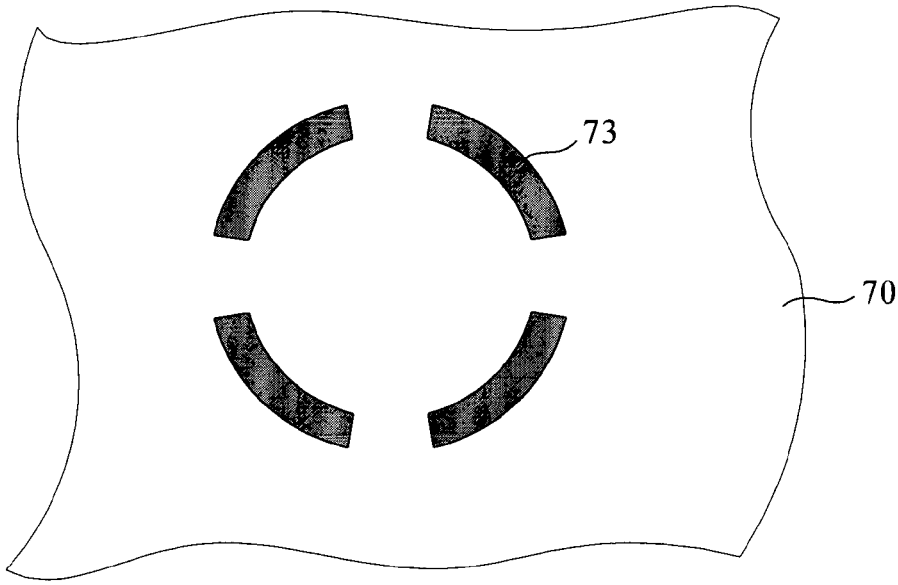
FIG. 2B shows a top view of the membrane circuit board of the key structure according to first embodiment of the present invention on which the adhesive is coated.

Please refer to FIG. 2B, with reference to FIG. 1 and FIG. 2A again, FIG. 2B shows a top view of the membrane circuit board 70 of the key structure 100 of the present invention on which the adhesive 73 is coated. The adhesive 73 is coated on the membrane circuit board 70 to become a form with a plurality of discontinuous adhesive portions 73 each of which corresponding to one of the flanges 65 of the bottom surface of the elastic contact body 63 for bonding the elastic contact body 63 onto the membrane circuit board 70. The area of each of the discontinuous adhesive portions 73 is smaller than that of the bottom surface of the flange 65 in order that the adhesive 73 is only spread within the area of the bottom surface of the flange 65 when pressed by the elastic contact body 63, and cannot be extruded out from between the elastic contact body 63 and the membrane circuit board 70. Furthermore, the embossed surface 67 of the bottom of the elastic contact body 63 increases the surface area to securely accommodate the discontinuous adhesive portions 73 to enhance bondability between the elastic contact body 63 and the membrane circuit board 70, and preventing the adhesive 73 from being extruded out from therebetween. When the key structure 100 of the present invention is to be assembled, the upper fixing portions 51 of the key cap 50 are pivotally fastened to the upper pivot joint portions 61 of the scissor-type frame 60. The elastic contact body 63 is placed between the key cap 50 and the membrane circuit board 70, and attached onto the membrane circuit board 70 by the discontinuous adhesive portions 73. The lower fixing portions 81 of the bottom board 80 pass the through holes 71 of the membrane circuit board 70 and engage with the lower pivot joint portions 62 of the scissor-type frame 60.

Figure 3A:
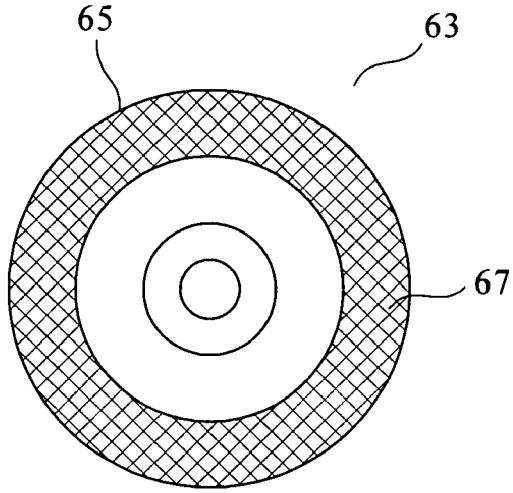
FIG. 3A shows a bottom view of the elastic contact body according to second embodiment of the present invention.
Figure 3B:
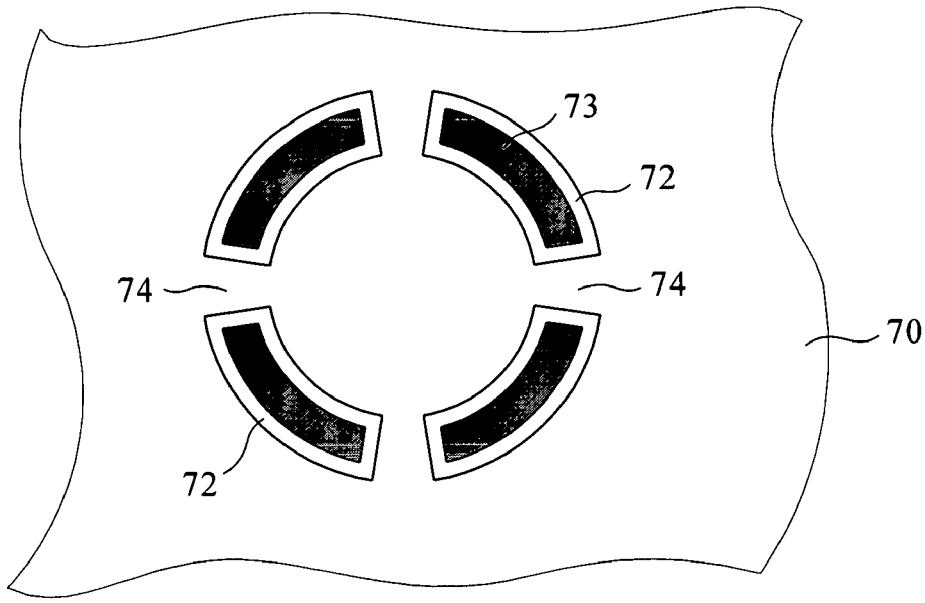
FIG. 3B shows a top view of the membrane circuit board according to second embodiment of the present invention.

Please refer to FIG. 3A, which shows a bottom view of the elastic contact body 63 according to second embodiment of the present invention. The flange 65 of the bottom of the elastic contact body 63 is formed of a continuous body, and the bottom surface of the flange 65 is formed as an embossed surface 67 having a cross-striped structure to increase the bonding area of the elastic contact body 63. Please refer to FIG. 3B, which shows a top view of the membrane circuit board 70 according to second embodiment of the present invention. A print layer 72 is formed on the area of the membrane circuit board 70 corresponding to the flange 65 of the bottom of the elastic contact body 63 so that a height difference is formed between the print layer 72 and the membrane circuit board 70. Moreover, the print layer 72 is formed of a plurality of discontinuous printing portions 72 between which a plurality of holes 74 is formed. An adhesive 73 is coated on the discontinuous printing portions 72 to bond the flange 65 of the elastic contact body 63 onto the membrane circuit board 70.

Figure 4:
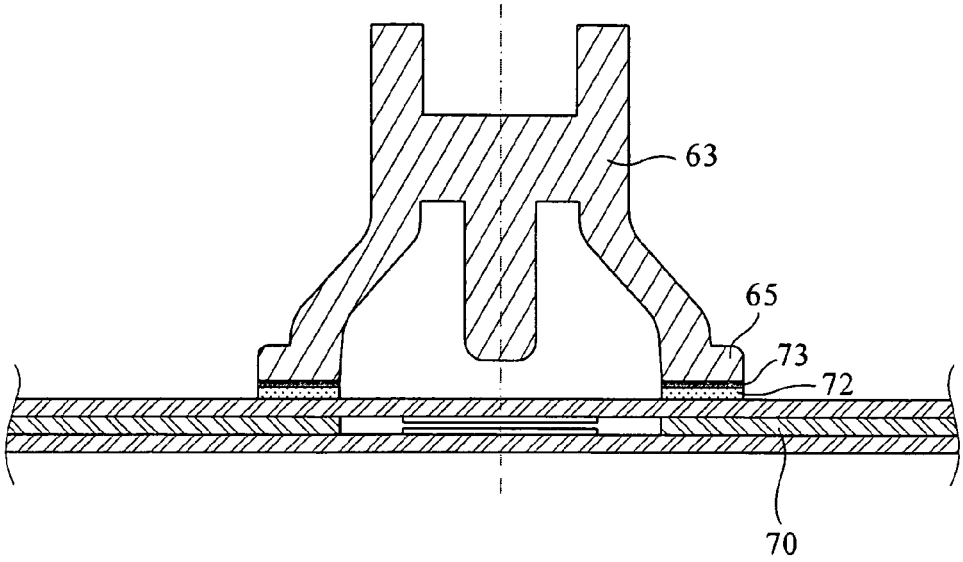
FIG. 4 shows a side sectional view of the elastic contact body and the membrane circuit board bonded together according to second embodiment of the present invention.
Figure 5:
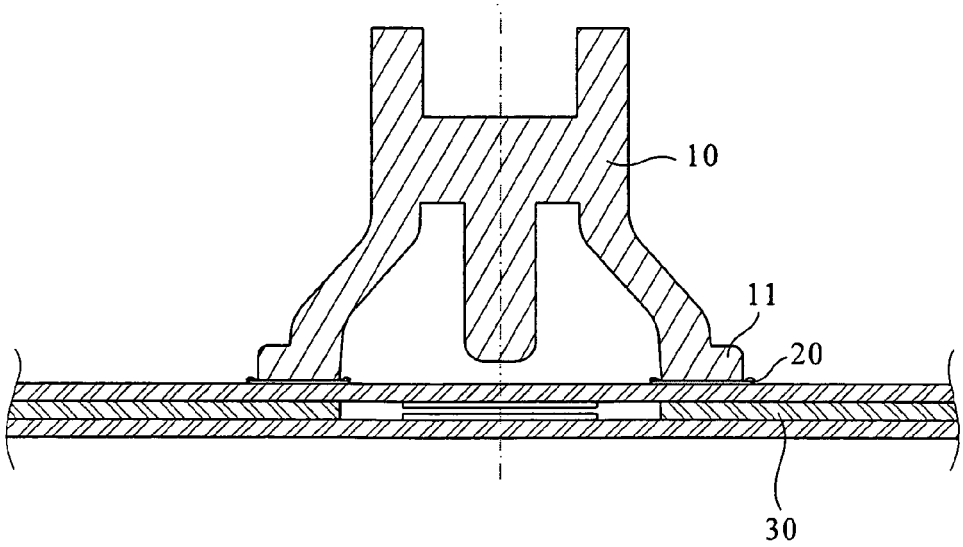
Fig. 5 ( Prior Art )
FIG. 5 shows a side sectional view of the elastic contact body and the membrane circuit board boned together of a conventional key structure.

Please refer to FIG. 4 with reference to FIG. 3B again, FIG. 4 shows a side sectional view of the elastic contact body 63 and the membrane circuit board 70 bonding together according to second embodiment of the present invention. By the height difference between the print layer 72 and the membrane circuit board 70 and a plurality of discontinuous printing portions 72 to form the holes 74, the press force caused by pressing the key can be released via the holes 74. Hence, it is not necessary to form additional holes on the elastic contact body 63. Furthermore, the embossed surface 67 of the bottom of the elastic contact body 63 increases the surface area to securely accommodate the adhesive 73 to enhance bondability between the elastic contact body 63 and the membrane circuit board 70, and preventing the adhesive 73 from being extruded out from therebetween.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein. For example, the embossed surface of the bottom of the flange of the elastic contact body is not limited to be bonded to the membrane circuit board; it can also be bonded to the print layer of the membrane circuit board. The adhesive is not limited to be coated on the membrane circuit board or the print layer; it can also be coated on the surface of the flange of the elastic contact body.

What is claimed is:

1. A key structure, comprising a key cap, a scissor-type frame, an elastic contact body, a membrane circuit board and a bottom board, said elastic contact body bonded to said membrane circuit board by an adhesive, wherein a print layer is provided on an area of said membrane circuit board corresponding to a bottom of said elastic contact body, said print layer is formed of a plurality of discontinuous printing portions between which a plurality of holes is formed, and the bottom of said elastic contact body is formed as an embossed surface.

2. The key structure as in claim 1, wherein said embossed surface of the bottom of said elastic contact body has a cross-striped structure or a grained structure.

3. The key structure as in claim 1, wherein said membrane circuit board is made of a single or triple-layered circuit board.

4. The key structure as in claim 1, wherein said bottom of said elastic contact body is further provided with a plurality of holes.

5. A key structure, comprising a key cap, a scissor-type frame, an elastic contact body, a membrane circuit board and a bottom board, said elastic contact body bonded to said membrane circuit board by an adhesive, wherein said elastic contact body is provided with a plurality of holes and the bottom of said elastic contact body bonding to said membrane circuit board is provided with an embossed surface.

6. The key structure as in claim 5, wherein said membrane circuit board is made of a single or triple-layered circuit board.

7. The key structure as in claim 5, wherein said embossed surface of the bottom of said elastic contact body has a cross-striped structure or a grained structure.

8. The key structure as in claim 5, wherein the adhesive is coated on the bottom of said elastic contact body or said membrane circuit board.

9. A key structure, comprising a key cap, a scissor-type frame, an elastic contact body, a membrane circuit board and a bottom board, said elastic contact body bonded to said membrane circuit board by an adhesive, wherein a print layer is provided on an area of said membrane circuit board corresponding to a bottom of said elastic contact body, said print layer is formed of a plurality of discontinuous printing portions between which a plurality of holes is formed, and the adhesive is coated on the bottom of said elastic contact body or said print layer of said membrane circuit board.

10. The key structure as in claim 9, wherein the bottom of said elastic contact body is formed as an embossed surface.

11. The key structure as in claim 10, wherein said embossed surface of the bottom of said elastic contact body has a cross-striped structure or a grained structure.

12. The key structure as in claim 9, wherein said membrane circuit board is made of a single or triple-layered circuit board.

13. The key structure as in claim 9, wherein said bottom of said elastic contact body is further provided with a plurality of holes.

* * * * *